US009250642B2

(12) United States Patent
Wu

(10) Patent No.: US 9,250,642 B2
(45) Date of Patent: Feb. 2, 2016

(54) CONSTANT CURRENT GENERATING CIRCUIT USING ON-CHIP CALIBRATED RESISTOR AND RELATED METHOD THEREOF

(71) Applicant: Realtek Semiconductor Corp., HsinChu (TW)

(72) Inventor: Chien-Ming Wu, Hsinchu County (TW)

(73) Assignee: Realtek Semiconductor Corp., Science Park, HsinChu (TW)

( * ) Notice: Subject to any disclaimer, the term of this patent is extended or adjusted under 35 U.S.C. 154(b) by 190 days.

(21) Appl. No.: 14/086,972

(22) Filed: Nov. 22, 2013

(65) Prior Publication Data

US 2014/0145702 A1 May 29, 2014

(30) Foreign Application Priority Data

Nov. 23, 2012 (TW) ..... 101143943 A

(51) Int. Cl.
*G05F 1/56* (2006.01)

(52) U.S. Cl.
CPC ..... *G05F 1/561* (2013.01)

(58) Field of Classification Search
CPC ..... G05F 1/561
See application file for complete search history.

(56) References Cited

U.S. PATENT DOCUMENTS

| | | | | |
|---|---|---|---|---|
| 6,373,266 | B1 * | 4/2002 | Carelli et al. | 324/716 |
| 6,590,441 | B2 * | 7/2003 | Papathanasiou | 327/530 |
| 6,836,170 | B2 * | 12/2004 | Kitagawa et al. | 327/308 |
| 6,862,714 | B2 * | 3/2005 | Jin et al. | 333/124 |
| 6,949,971 | B2 * | 9/2005 | Jang | 327/541 |
| 7,345,503 | B2 | 3/2008 | Chen | |
| 7,345,504 | B2 * | 3/2008 | Lin et al. | 326/30 |
| 7,514,954 | B2 * | 4/2009 | Kim et al. | 326/30 |
| 7,616,042 | B2 * | 11/2009 | Suzuki | 327/291 |
| 2003/0102932 | A1 * | 6/2003 | Lee et al. | 333/17.3 |
| 2008/0246537 | A1 * | 10/2008 | Aziz | 327/540 |
| 2012/0154027 | A1 * | 6/2012 | Liao et al. | 327/543 |
| 2014/0355651 | A1 * | 12/2014 | Hong et al. | 374/170 |

FOREIGN PATENT DOCUMENTS

| | | | |
|---|---|---|---|
| CN | 1900923 | A | 1/2007 |
| EP | 2 023 487 | A1 | 2/2009 |
| TW | 200709234 | | 3/2007 |
| WO | 2005062150 | A1 | 7/2005 |

* cited by examiner

*Primary Examiner* — Thomas J Hiltunen
(74) *Attorney, Agent, or Firm* — Winston Hsu; Scott Margo

(57) ABSTRACT

A constant current generating circuit and constant current generating method applied to a chip are provided, where the chip includes a first current generating circuit and a second current generating circuit, the second current generating circuit includes a transistor and an adjustable resistor. The constant current generating method includes: connecting an external resistor to the first current generating circuit to make the first current generating circuit use the external resistor to generate a first current; utilizing the second current generating circuit to generate a second current; adjusting the adjustable resistor in accordance with the first current and the second current to make the second current substantially equal to the first current, where the second current serves as a constant current of the chip.

5 Claims, 4 Drawing Sheets

CONSTANT CURRENT GENERATING CIRCUIT USING ON-CHIP CALIBRATED RESISTOR AND RELATED METHOD THEREOF

BACKGROUND OF THE INVENTION

1. Field of the Invention

The disclosed embodiments of the present invention relate to a constant current generating circuit, and more particularly, to a constant current generating circuit which utilizes a calibrated resistor inside a chip to generate constant current and related method thereof.

2. Description of the Prior Art

Generally speaking, an accurate current source inside a chip is needed to provide a constant current for circuit elements; however, due to that the resistance values of resistors inside the chip may not be accurate as desired, a manner to realize a precise current source is usually by using a bandgap voltage and an external resistor. As mentioned above, the production cost of the chip related design is increased inevitably due to the need for an additional external resistor.

SUMMARY OF THE INVENTION

Therefore, one of the objectives of the present invention is to provide a constant current generating circuit and associated constant current generating method which can utilize the calibrated resistor inside the chip to generate a constant current without any additional calibration circuit, to solve the above problems.

According to a first aspect of the present invention, a constant current generating circuit applied to a chip is disclosed. The constant current generating circuit includes a first current generating circuit, a second current generating circuit, a current mirror, a switch module, and a calibration circuit. The first current generating circuit includes a first transistor, wherein the first transistor is coupled to a contact of the chip, and the contact is utilized to connect to an external resistor for allowing the first current generating circuit to generate a first current in a chip testing phase. The second current generating circuit includes a second transistor and an adjustable resistor, arranged to generate a second current. The switch module is coupled between the first current generating circuit, the second current generating circuit and the current mirror, arranged to connect the first current generating circuit and the second current generating circuit to the current mirror to make the current mirror duplicate the first current or the second current. The calibration circuit is coupled to the current mirror, arranged to adjust the resistance of the adjustable resistor in accordance with the first current and the second current duplicated by the current mirror to make the second current substantially equal to the first current, where the second current serves as a constant current of the chip.

According to a second aspect of the present invention, a constant current generating method applied to a chip is disclosed, where the chip comprises a first current generating circuit and a second current generating circuit, the second current generating circuit comprises a transistor and an adjustable resistor. The constant current generating method includes: connecting an external resistor to the first current generating circuit to make the first current generating circuit use the external resistor to generate a first current; utilizing the second current generating circuit to generate a second current; and adjusting the resistance of the adjustable resistor in accordance with the first current and the second current to make the second current substantially equal to the first current, where the second current serves as a constant current of the chip.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is electrically connected to another device, that connection may be through a direct electrical connection, or through an indirect electrical connection via other devices and connections.

Figure 1:
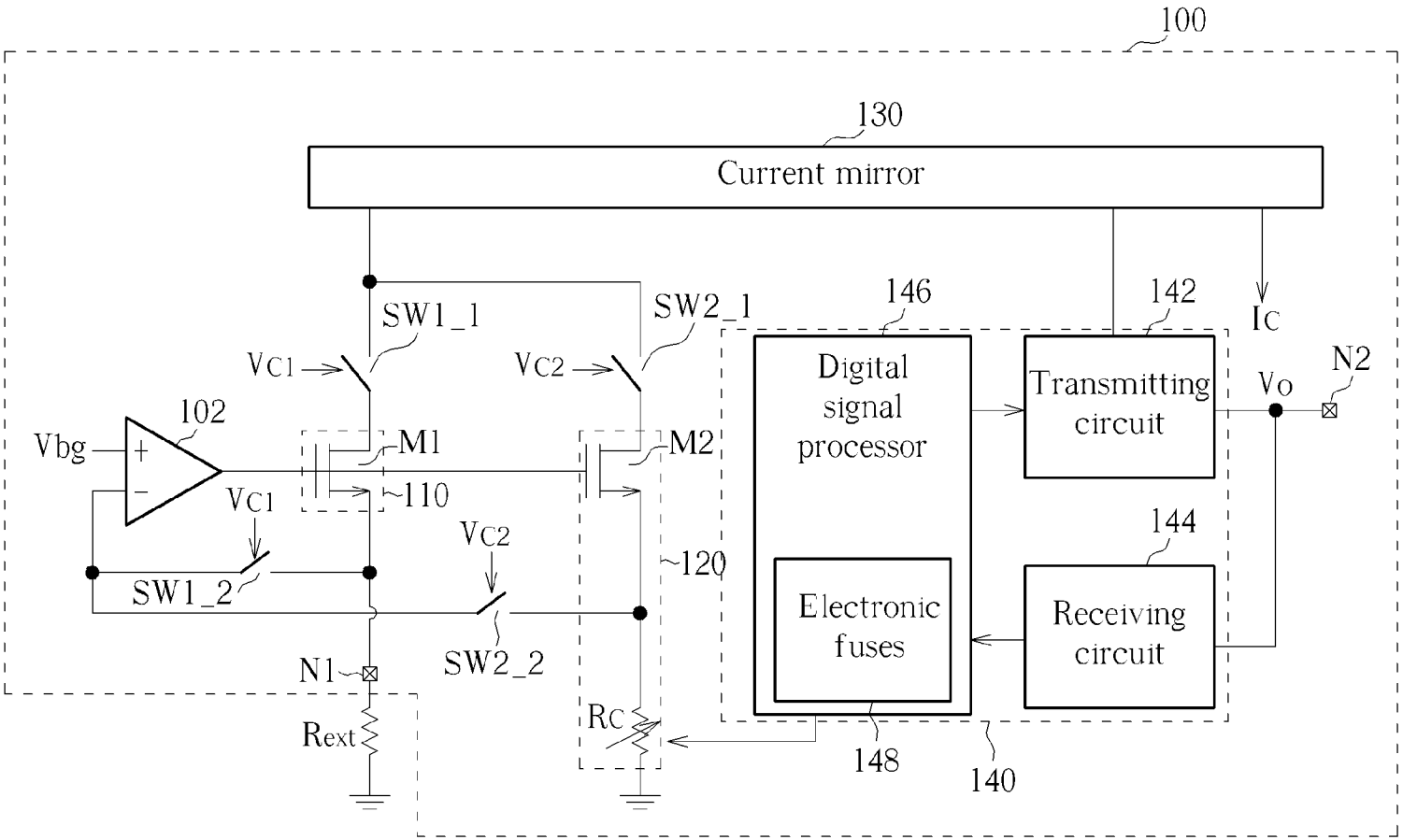
FIG. 1 is a diagram illustrating a constant current generating circuit in accordance with an embodiment of the present invention.

Please refer to FIG. 1, which is a diagram illustrating a constant current generating circuit 100 in accordance with an embodiment of the present invention. As shown in FIG. 1, the constant current generating circuit 100 is used to generate a constant current Ic, and includes an operational amplifier 102, a first current generating circuit 110, a second current generating circuit 120, a current mirror 130, a switch module (in this embodiment, the switch module includes switches SW1_1, SW1_2, SW1_3, and SW1_4), and a calibration circuit 140, wherein the first current generating circuit 110 includes a transistor M1, the second current generating circuit 120 includes a transistor M2 and an adjustable resistor Rc, the calibration circuit 140 includes a transmitting circuit 142, a receiving circuit 144, and a digital signal processor 146. The digital signal processor 146 contains a plurality of electronic fuses (Efuses) 148.

In this embodiment, the constant current generating circuit 100 is disposed in a chip, and a contact N1 shown in FIG. 1 is a contact of the chip. In a chip testing phase, the contact N1 is used to connect an external resistor Rext such that the first current generating circuit 110 generates a first current correspondingly. In addition, a contact N2 shown in FIG. 1 is a signal output contact of the chip for transmitting the signal outputted by the transmitting circuit 142 to the outside of the chip.

In an embodiment of the present invention, the chip employing the constant current generating circuit 100 may be a network control chip, and the transmitting circuit 142 and the receiving circuit 144 may be part of an analog front end (AFE) circuit of the chip. In addition, the transmitting circuit 142, which is used to receive network data from the digital signal processor 146, and transmit the received and processed network data to a transmission line outside the chip via the contact N2, may be implemented by a digital-to-analog converter (DAC); besides, the receiving circuit 144, which is used to receive network data from the contact N2 and transmit the received and analog-to-digital converted network data to the digital signal processor 146 for subsequent processing, may be implemented by an analog-to-digital converter (ADC).

Figure 2:
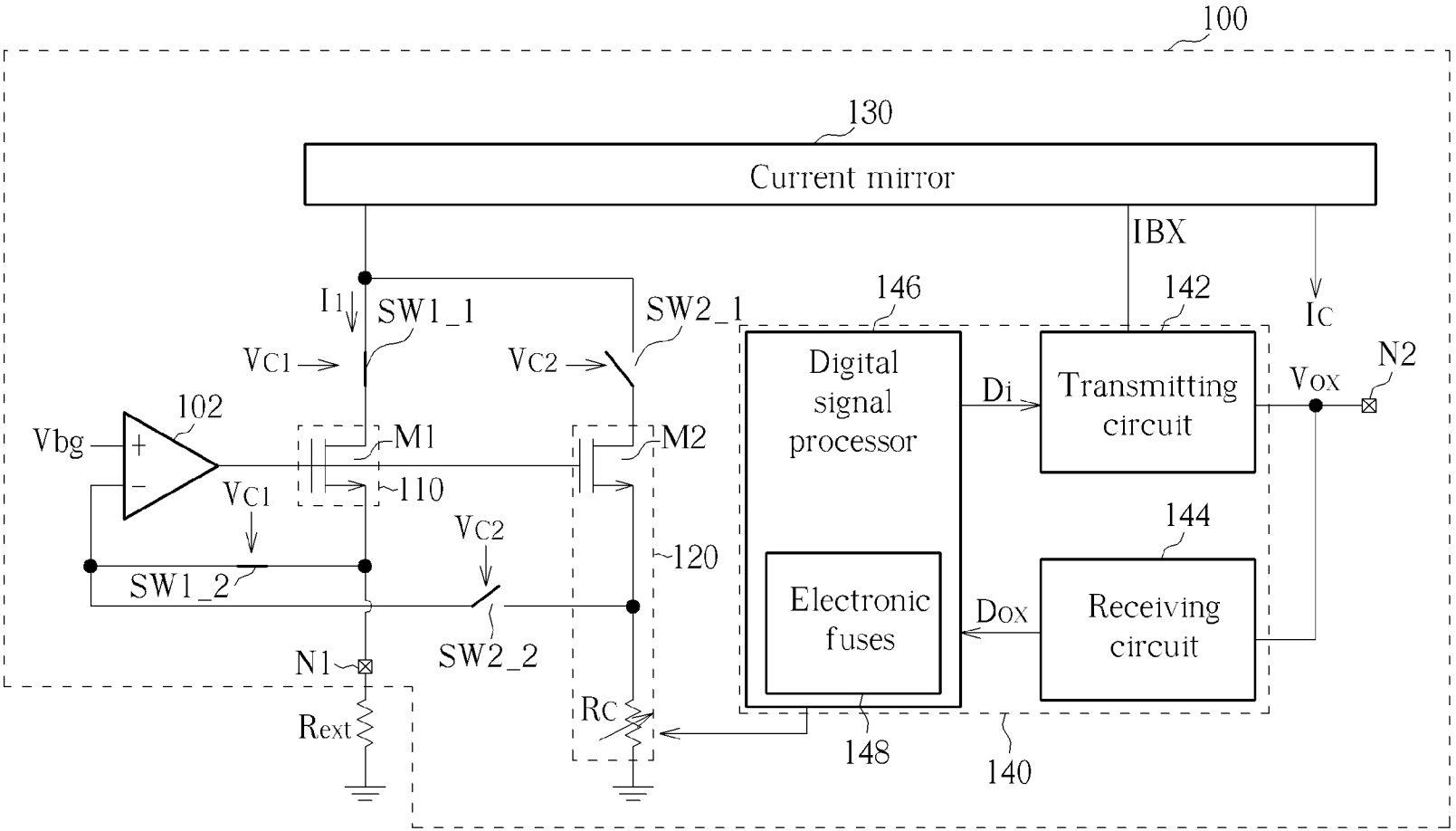
FIG. 2 is a diagram illustrating the first current generated by a constant current generating circuit and the corresponding first digital code in a chip testing phase.

Regarding a chip testing phase, please refer to FIG. 2. First, the constant current generating circuit 100 is connected to the external resistor Rext via the contact N1, the switches SW1_1 and SW1_2 are turned on based on the control of the control signal VC1, and the switches SW2_1 and SW2_2 remain turned off based on the control of the control signal VC2, wherein the control signals Vc1 and VC2 may be generated by the digital signal processor 146 or other signal sources. At this time, since the positive/non-inverting input node of the operational amplifier 102 is connected to a bandgap voltage Vbg, the first current generating circuit 110 will generate a first current I1 with a current value equal to Vbg/Rext, and the current mirror 130 will duplicate the first current I1 to produce a mirrored current IBX. Thereafter, the transmitting circuit 142 will convert the mirrored current IBX into a first voltage Vox in accordance with a reference data Di obtained from the digital signal processor 146, wherein the reference data Di is used to determine the ratio of the conversion from the mirrored current IBX to the first voltage Vox that is performed by the transmitting circuit 142. After that, the receiving circuit 144 will convert the first voltage Vox into a first digital code Dox, and then the first digital code Dox is sent to the digital signal processor 146 and stored in the digital signal processor 146.

Figure 3:
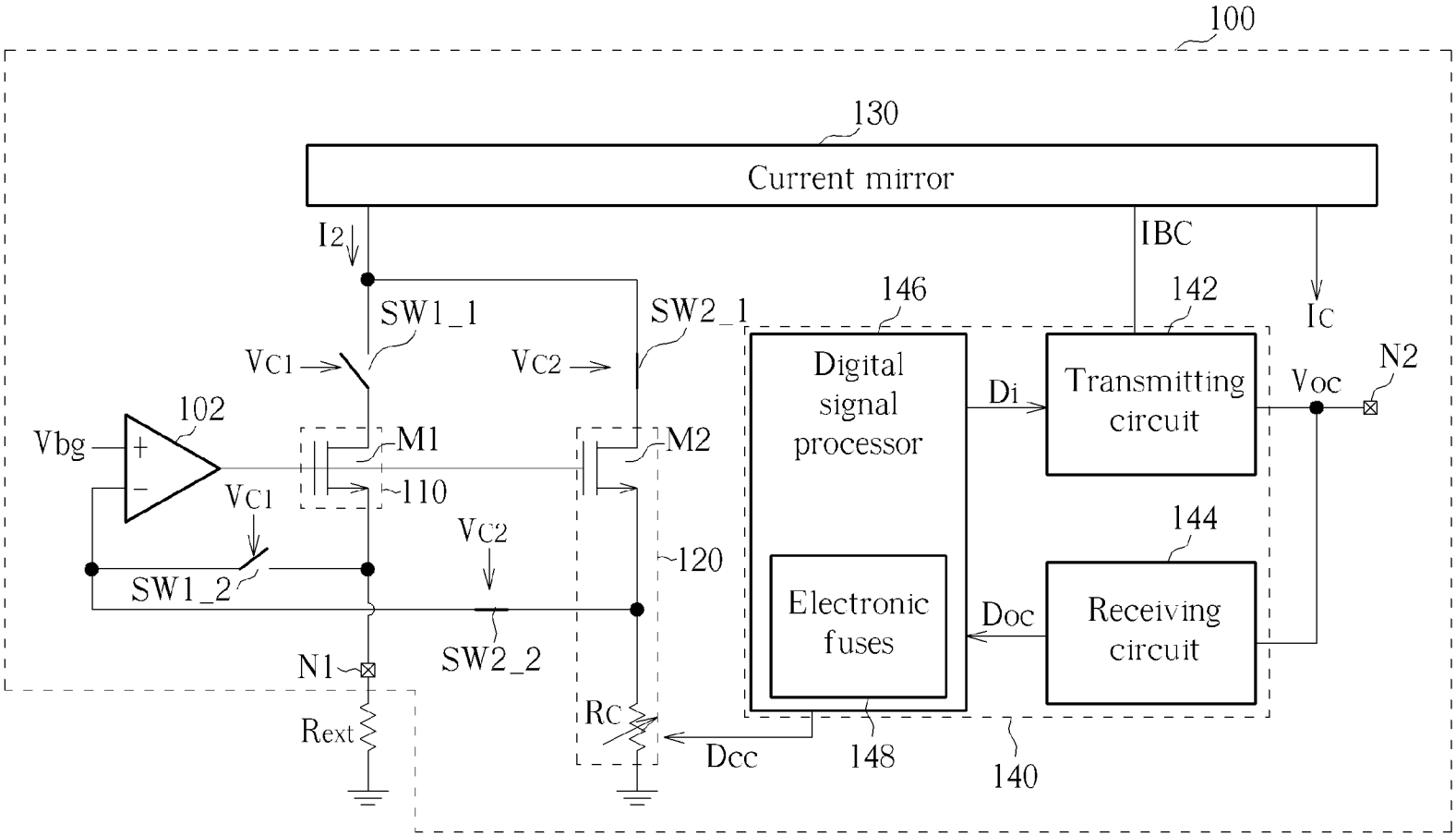
FIG. 3 is a diagram illustrating the second current generated by a constant current generating circuit and the corresponding second digital code in a chip testing phase.

Please refer to FIG. 3. After the first digit code Dox is stored in the digital signal processor 146, the switches SW1_1 and SW1_2 remain turned off based on the control of the control signal $V_{C1}$, the switches SW2_1 and SW2_2 are turned on based on the control of the control signal $V_{C2}$. At this time, since the positive/non-inverting input node of the operational amplifier 102 is connected to a bandgap voltage Vbg, the second current generating circuit 120 will generate a second current $I_2$ with a current value equal to Vbg/Rc, and the current mirror 130 will duplicate the second current $I_2$ to generate a mirrored current IBC. Thereafter, the transmitting circuit 142 will convert the mirrored current IBC into a second voltage Voc in accordance with the reference data Di obtained from the digital signal processor 146. Next, the receiving circuit 144 will convert the second voltage Voc into a second digital code Doc, and then the second digital code Doc is sent to the digital signal processor 146 and stored in the digital signal processor 146.

Then, since the first digital code Dox and the second digital code Doc stored in the digital signal processor 146 represent the current values of the first current $I_1$ and the second current $I_2$ respectively, the digital signal processor 146 can generate a correction code Dcc according to the first digital code Dox and the second digital code Doc to adjust the resistance value of the adjustable resistor Rc, thereby allowing the current generated by the second current generating circuit 120 to be close to the current generated by the first current generating circuit 110 as much as possible. For example, the digital signal processor 146 may utilize the code values or the code difference of the first digit code Dox and the second digital code Doc to search a look-up table for the correction code Dcc used to adjust the adjustable resistor Rc; or the digital signal processor 146 may generate different correction codes Dcc (which have different code values) continuously to adjust the resistance value of the adjustable resistor Rc, such that the current $I_2$ generated by the second current generating circuit 120 and the corresponding second digital code Doc would change continuously until the second digital code DOC is very close to the first digital code Dox.

Through the above-described adjustment, the resistance value of the adjustable resistor Rc will be very close to the resistance value of the external resistor Rext. Therefore, the current $I_2$ generated by the second current generating circuit 120 will be very close to the current $I_1$ generated by the first current generating circuit 110. At this point, the digital signal processor 146 may utilize the electronic fuse 148 to record the current correction code Dcc. Therefore, in the subsequent use of the chip, the resistance value of the adjustable resistor Rc is fixed since the correction code Dcc is fixed by the electronic fuse 148. In this way, the chip can utilize the second current generating circuit 120 to generate a desired constant current Ic. Since the external resistor is no longer needed in the subsequent use of the chip, the subsequent production cost is reduced.

In addition, due to the fact that the calibration circuit 140 of the constant current generating circuit 100 is implemented using the transmitting circuit 142 and the receiving circuit 144 of the chip per se, there is no need to add additional calibration circuits in the chip, thus reducing the cost of the chip design and manufacture.

However, it should be noted that although the calibration circuit 140 is implemented using the transmitting circuit 142 and the receiving circuit 144 of the chip per se according to the embodiment in FIG. 2, the present invention is not limited thereto. In other embodiments of the present invention, the calibration circuit 140 may be an independent calibration circuit in a chip and may have other types of calibration circuit design. To put it another way, the calibration circuit 140 may be implemented without using the transmitting circuit 142 and the receiving circuit 144 of the chip per se. These design changes should also belong to the scope of the present invention.

Figure 4:
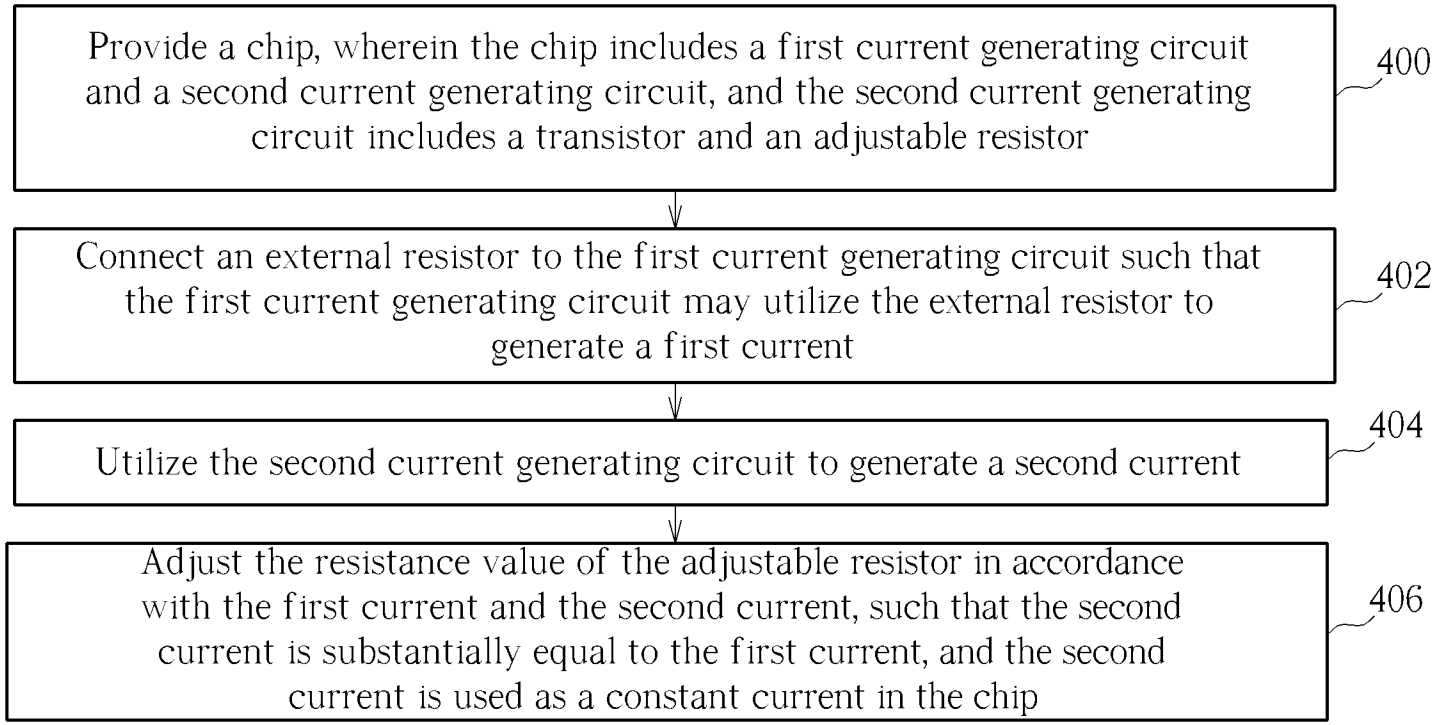
FIG. 4 is a flowchart illustrating the method of generating the constant current according to an embodiment of the present invention.

Please refer to FIG. 4, which is a flowchart illustrating a method of generating the constant current according to an embodiment of the present invention. Referring to FIGS. 1-4 and the disclosed contents directed to FIGS. 1-3, the flow is described as below:

Step 400: Provide a chip, wherein the chip includes a first current generating circuit and a second current generating circuit, and the second current generating circuit includes a transistor and an adjustable resistor;

Step 402: Connect an external resistor to the first current generating circuit such that the first current generating circuit may utilize the external resistor to generate a first current;

Step 404: Utilize the second current generating circuit to generate a second current;

Step 406: Adjust the resistance value of the adjustable resistor in accordance with the first current and the second current, such that the second current is substantially equal to the first current, and the second current is used as a constant current in the chip.

In summary, the constant current generating circuit and associated method of the present invention can adjust the resistance value of an adjustable resistor in a chip to be close to the resistance value of an external resistor. In this way, the chip can use the calibrated internal resistor to produce a reliable constant current. As there is no need for an external resistor, the proposed design does reduce the following production cost. In addition, the calibration circuit of the constant current generating circuit of the present invention can be implemented using the transmitting circuit and the receiving circuit of the chip per se. Therefore, additional hardware of the calibration circuit is not needed at all, which further reduces the cost of the chip design and manufacture.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A constant current generating circuit disposed in a chip, comprising:

a first current generating circuit, comprising a first transistor, wherein the first transistor is coupled to a contact of the chip; and in a chip testing phase, the contact is utilized to connect to an external resistor for allowing the first current generating circuit to generate a first current;

a second current generating circuit, comprising a second transistor and an adjustable resistor, the second current generating circuit arranged to generate a second current;

a current mirror;

a switch module, coupled between the first current generating circuit, the second current generating circuit and the current mirror, the switch module arranged to selectively connect the first current generating circuit or the second current generating circuit to the current mirror to make the current mirror duplicate the first current or the second current; and a calibration circuit, coupled to the current mirror, the calibration circuit arranged to adjust a resistance value of the adjustable resistor in accordance with the first current and the second current duplicated by the current mirror to make the second current substantially equal to the first current, wherein the second current serves as a constant current of the chip;

wherein in the chip testing phase, the switch module connects the first current generating circuit to the current mirror, and disconnects the second current generating circuit from the current mirror, and the calibration circuit receives the first current duplicated by the current mirror; and the switch module further connects the second current generating circuit to the current mirror, and disconnects the first current generating circuit from the current mirror, and the calibration circuit adjusts the resistance value of the adjustable resistor in accordance with the first current and the second current duplicated by the current mirror to make the second current substantially equal to the first current;

wherein the calibration circuit comprises an analog front end circuit of the chip; and the calibration circuit comprises:

a transmitting circuit, arranged for receiving the first current duplicated by the current mirror to generate a first voltage, and receiving the second current duplicated by the current mirror to generate a second voltage;

a receiving circuit, coupled to the transmitting circuit, the receiving circuit arranged for receiving the first voltage to generate a first digital code, and receiving the second voltage to generate a second digital code; and a digital signal processor, coupled to the receiving circuit, the digital signal processor arranged for adjusting the resistance value of the adjustable resistor in accordance with the first digital codes and the second digital code.

2. The constant current generating circuit of claim 1, wherein the chip is a network control chip, and the transmitting circuit and the receiving circuit in the network control chip are utilized to send and receive network related signals, respectively.

3. The constant current generating circuit of claim 1, wherein the digital signal processor comprises a plurality of electronic fuses, and the digital signal processor controls the plurality of electronic fuses to generate a correction code in accordance with the first digital code and the second digital code, and the correction code is used to adjust the resistance value of the adjustable resistor.

4. A constant current generating method applied to a chip, wherein the chip comprises a first current generating circuit and a second current generating circuit, and the second current generating circuit comprises a transistor and an adjustable resistor, the constant current generating method comprising:

connecting an external resistor to the first current generating circuit such that the first current generating circuit uses the external resistor to generate a first current;

utilizing the second current generating circuit to generate a second current; and adjusting a resistance value of the adjustable resistor in accordance with the first current and the second current to make the second current substantially equal to the first current, wherein the second current serves as a constant current of the chip;

wherein the step of adjusting the resistance value of the adjustable resistor in accordance with the first current and the second current to make the second current substantially equal to the first current comprises:

utilizing a transmitting circuit of an analog front end circuit of the chip to receive the first current to generate the first voltage, and receive the second current to generate the second voltage;

utilizing a receiving circuit of the analog front end circuit of the chip to receive the first voltage to generate the first digital code, and receive the second voltage to generate the second digital code; and adjusting the resistance value of the adjustable resistor in accordance with the first digital codes and the second digital code;

wherein the chip is a network control chip, and the transmitting circuit and the receiving circuit in the network control chip are utilized to send and receive network related signals, respectively.

5. A constant current generating method applied to a chip, wherein the chip comprises a first current generating circuit and a second current generating circuit, and the second current generating circuit comprises a transistor and an adjustable resistor, the constant current generating method comprising:

connecting an external resistor to the first current generating circuit such that the first current generating circuit uses the external resistor to generate a first current;

utilizing the second current generating circuit to generate a second current; and adjusting a resistance value of the adjustable resistor in accordance with the first current and the second current to make the second current substantially equal to the first current, wherein the second current serves as a constant current of the chip;

wherein the step of adjusting the resistance value of the adjustable resistor in accordance with the first current and the second current to make the second current substantially equal to the first current comprises:

receiving the first current to generate a first voltage;

receiving the first voltage to generate a first digital code;

receiving the second current to generate a second voltage;

receiving the second voltage to generate a second digital code; and controlling a plurality of electronic fuses of the chip to generate a correction code in accordance with the first digital code and the second digital code, wherein the correction code is used to adjust the resistance value of the adjustable resistor.

* * * * *